United States Patent [19]

Greenwood

[11] 4,277,325

[45] Jul. 7, 1981

[54] TREATMENT OF PITCHES IN CARBON ARTIFACT MANUFACTURE

[75] Inventor: Sydney H. J. Greenwood, Sarnia, Canada

[73] Assignee: Exxon Research & Engineering Co., Florham Park, N.J.

[21] Appl. No.: 146,157

[22] Filed: May 2, 1980

Related U.S. Application Data

[63] Continuation-in-part of Ser. No. 29,760, Apr. 13, 1979.

[51] Int. Cl.[3] ..... C10C 3/16

[52] U.S. Cl. ..... 208/45; 208/22; 423/447.4; 423/447.6; 423/448; 264/29.2

[58] Field of Search ..... 208/45, 96, 309, 22, 208/23; 423/447.4

[56] References Cited

U.S. PATENT DOCUMENTS

| | | | |
|---|---|---|---|
| 3,087,887 | 4/1963 | Corbett | 208/23 |
| 3,595,946 | 7/1971 | Joo | 423/447.6 |
| 3,919,376 | 11/1975 | Schulz | 423/447 |
| 3,919,387 | 11/1975 | Singer | 423/447 |
| 4,005,183 | 1/1977 | Singer | 423/447.2 |
| 4,055,583 | 10/1977 | Kolling | 208/45 |
| 4,116,815 | 9/1978 | Sunago | 208/87 |
| 4,127,472 | 11/1978 | Migitaka | 208/45 |
| 4,184,942 | 1/1980 | Angier | 208/22 |
| 4,208,267 | 6/1980 | Diefendorf | 208/45 |

*Primary Examiner*—Brian E. Hearn

*Attorney, Agent, or Firm*—Joseph J. Dvorak

[57] ABSTRACT

The present invention contemplates a process for treating an isotropic carbonaceous graphitizable pitch with an organic fluxing liquid to provide a fluid pitch which has suspended therein substantially all of the quinoline insoluble material in the pitch and which solid material is readily separable by filtering, centrifugation and the like. Thereafter, the fluid pitch is treated in at least two steps with an antisolvent compound, the sum total of which is sufficient to precipitate at least a substantial portion of the pitch, the amount of antisolvent employed in each step increasing from the first step to the last step. In a particularly preferred embodiment of the present invention, the fluid pitch is treated in two steps with an antisolvent compound with from 5% to 15% of the antisolvent compound being used in the first step and from 85% to 95% of the antisolvent compound being used in the second step.

7 Claims, No Drawings

TREATMENT OF PITCHES IN CARBON ARTIFACT MANUFACTURE

CROSS-REFERENCE TO RELATED APPLICATIONS

This application is a continuation-in-part of U.S. application Ser. No. 29,760, filed Apr. 13, 1979.

FIELD OF THE INVENTION

The subject invention is concerned generally with the preparation of a feedstock for carbon artifact manufacture from carbonaceous residues of petroleum origin including distilled or cracked residuums of crude oil and hydrodesulfurized residues of distilled or cracked crude oil. More particularly, the invention is concerned with the treatment of carbonaceous graphitizable petroleum pitches to obtain a feedstock eminently suitable for carbon fiber production.

DESCRIPTION OF THE PRIOR ART

Carbon artifacts have been made by pyrolyzing a wide variety of organic materials. One carbon artifact of commercial interest today is carbon fiber. Hence, particular reference is made herein to carbon fiber technology. Nonetheless, it should be appreciated that this invention has applicability to carbon artifact formation generally and, most particularly, to the production of shaped carbon articles in the form of filaments, yarns, ribbons, films and sheets and the like.

Referring now in particular to carbon fibers, suffice it to say that the use of carbon fibers in reinforcing plastic and metal matrices has gained considerable commercial acceptance where the exceptional properties of the reinforcing composite materials such as their high strength-to-weight ratios clearly offset the generally high costs associated with preparing them. It is generally accepted that large scale use of carbon fibers as a reinforcing material would gain even greater acceptance in the market-place if the costs associated with the formation of the fibers could be substantially reduced. Thus, the formation of carbon fibers from relatively inexpensive carbonaceous pitches has received considerable attention in recent years. See, for example, U.S. Pat. Nos. 3,919,387, 3,919,376 and 4,005,183.

Many carbonaceous pitches are known to be converted at the early stages of carbonization to a structurally ordered, optically anisotropic spherical liquid called mesophase. The presence of this ordered structure prior to carbonization is considered to be a significant determinant of the fundamental properties of any carbon artifact made from such a carbonaceous pitch. The ability to generate high optical anisotropicity during processing is generally accepted, particularly in carbon fiber production, as a prerequisite to the formation of high quality products. Thus, one of the first requirements of any feedstock material suitable for carbon fiber production is its ability to be converted to a highly optically anisotropic material.

As is well known, pitches typically include insoluble and infusable materials which are insoluble in organic solvents such as quinoline or pyridine. These insoluble materials, commonly referred to as quinoline insolubles, normally consist of coke, carbon black, catalyst fines and the like. In carbon fiber production, it is necessary, of course, to extrude the pitch through a spinnerette having very fine orifices. Consequently, the presence of any quinoline insoluble material is highly undesirable since it can plug or otherwise foul the spinnerette during fiber formation.

Additionally, since many carbonaceous pitches have relatively high softening points, incipient coking frequently occurs in such materials at temperatures where they exhibit sufficient viscosity for spinning. The presence of coke and other infusable materials and/or undesirably high softening point components generated prior to or at the spinning temperature are detrimental to processability and product quality. Moreover, a carbonaceous pitch or feedstock for carbon fiber production must have a relatively low softening point or softening point range and a viscosity suitable for spinning the feedstock into fibers. Thus, for example, U.S. Pat. No. 3,919,376 discloses the difficulty in deforming pitches which undergo coking and/or polymerization at the softening temperature of the pitch. Finally, the feedstock must not contain components which are volatile at spinning or carbonization temperatures since such components also are detrimental to product quality.

Significantly, in U.S. application Ser. No. 930,172, filed May 5, 1978, it has recently been disclosed that typical graphitizable carbonaceous pitches contain a separable fraction which possesses very important physical and chemical properties insofar as carbon fiber production is concerned. Indeed, this separable fraction of typical graphitizable carbonaceous pitches exhibits a softening range and viscosity suitable for spinning and has the ability to be converted rapidly at temperatures in the range generally of about 230° C. to about 400° C. to an optically anisotropic deformable pitch containing greater than 75% of a liquid crystal type structure. Since this highly oriented optically anisotropic pitch material formed from a fraction of an isotropic carbonaceous pitch has substantial solubility in pyridine and quinoline, it has been named neomesophase to distinguish it from the pyridine and quinoline insoluble liquid crystal materials long since known and referred to in the prior art as mesophase. The amount of this separable fraction of pitch present in well-known commercially available graphitizable pitches, such as Ashland 240 and Ashland 260, to mention a few, is relatively low. For example, with Ashland 240, no more than about 10% of the pitch constitutes a separable fraction capable of being thermally converted to neomesophase.

U.S. Pat. No. 4,184,942 does disclose a process for increasing the amount of that fraction present in a carbonaceous pitch which is suitable for spinning and which is capable of being converted rapidly to a highly optically anisotropic phase. Basically, the process disclosed requires heating the pitch at elevated temperatures until spherules visible under polarized light begin to appear in the pitch. This heat soaking of the pitch results in an increase in the amount of that fraction of the pitch capable of being converted to an optically anisotropic phase.

In copending Application Ser. No. 29,760, filed Apr. 13, 1979, there is disclosed a process for treating isotropic carbonaceous pitch so as to remove the quinoline insoluble and other undesirable high softening point components present in the pitch. Basically, the isotropic pitch is treated with an organic fluxing agent to provide a fluid pitch which has suspended therein substantially all of the quinoline insoluble material in the fluid pitch in the form of a readily separable solid. Thereafter the pitch is treated with an antisolvent compound so as to precipitate at least a substantial portion of the pitch free of quinoline insolubles. As should be appreciated, the precise properties of the pitch separated in this manner will vary depending upon numerous factors such as the source of the pitch, its thermal history and the like.

Thus, there remains a need for a simple process for treating isotropic carbonaceous pitches to provide a feedstock, suitable for carbon artifact manufacture, which possesses the requisite softening point and viscosity for deforming into shaped carbon articles, especially carbon fiber.

SUMMARY OF THE INVENTION

It now has been discovered that a carbonaceous pitch which has been rendered fluid by fluxing with an organic fluxing agent can be treated in a staged sequence with increasing amounts of an antisolvent compound so as to effectively fractionate the pitch into a plurality of separable precipitants, each fraction having lower softening points.

Broadly speaking, then, the present invention contemplates a process for treating an isotropic carbonaceous graphitizable pitch with an organic fluxing liquid to provide a fluid pitch which has suspended therein substantially all of the quinoline insoluble material in the pitch and which solid material is readily separable by filtering, centrifugation and the like. Thereafter, the fluid pitch is treated in at least two steps with an antisolvent compound, the sum total of which is sufficient to precipitate at least a substantial portion of the pitch, the amount of antisolvent employed in each step increasing from the first step to the last step. In a particularly preferred embodiment of the present invention, the fluid pitch is treated in two steps with an antisolvent compound with from 5% to 15% of the antisolvent compound being used in the first step and from 85% to 95% of the antisolvent compound being used in the second step.

The fluxing compounds suitable in the practice of the present invention include tetrahydrofuran, toluene, light aromatic gas oils, heavy aromatic gas oils, tetralin and the like when used in the ratio of, for example, from about 0.5 parts by weight of fluxing compound per weight of pitch to about 3 parts of fluxing compound per weight of pitch. Preferably, the weight ratio of fluxing compound to pitch is in the range of about 1:1 to 2:1.

Among the antisolvents suitable in the practice of the present invention are those solvents in which isotropic carbonaceous pitches are relatively insoluble and such antisolvent substances include aliphatic and aromatic hydrocarbons such as heptane and the like. For reasons which are described hereinafter in greater detail, it is particularly preferred that the antisolvent compound employed in the practice of the present invention have a solubility parameter of between about 8.0 and 9.5 at 25° C.

These and other embodiments of the present invention will be more readily understood from the following detailed description.

DETAILED DESCRIPTION OF THE INVENTION

The term "pitch" as used herein means petroleum pitches, natural asphalt and pitches obtained as by-products in the naphtha cracking industry, pitches of high carbon content obtained from petroleum, asphalt and other substances having properties of pitches produced as by-products in various industrial production processes.

The term "petroleum pitch" refers to the residuum carbonaceous material obtained from the thermal and catalytic cracking of petroleum distillates including a hydrodesulfurized residuum of distilled and cracked crude oils.

Generally pitches having a high degree of aromaticity are suitable for carrying out the present invention. Indeed, aromatic carbonaceous pitches having high aromatic carbon contents of from about 75% to about 90% as determined by nuclear magnetic resonance spectroscopy are generally useful in the process of this invention. So, too, are high boiling, highly aromatic streams containing such pitches or that are capable of being converted into such pitches.

On a weight basis, the useful pitches will have from about 88% to about 93% carbon and from about 7% to about 5% hydrogen. While elements other than carbon and hydrogen, such as sulfur and nitrogen, to mention a few, are normally present in such pitches, it is important that these other elements do not exceed 4% by weight of the pitch, and this is particularly true when forming carbon fibers from these pitches. Also, these useful pitches typically will have a number average molecular weight of the order of about 300 to 4,000.

Those petroleum pitches which are well-known graphitizable pitches meeting the foregoing requirements are preferred starting materials for the practice of the present invention. Thus, it should be apparent that carbonaceous residues of petroleum origin, and particularly isotropic carbonaceous petroleum pitches which are known to form mesophase in substantial amounts, for example in the order of 75% to 95% by weight and higher, during heat treatment at elevated temperatures, for example in the range of 350° C. to 450° C., are especially preferred starting materials for the practice of the present invention.

As stated above, it has been recently discovered that pitches of the foregoing type have a soluble insoluble separable fraction which is referred to as a neomesophase former fraction, or NMF fraction, which is capable of being converted to an optically anisotropic pitch containing greater than 75% of a highly oriented liquid crystalline material referred to as neomesophase. Importantly, the NMF fraction, and indeed the neomesophase itself, has sufficient viscosity at temperatures in the range, for example, of 230° C. to about 400° C., such that it is capable of being spun into pitch fiber. The amount of neomesophase former fraction of the pitch tends, however, to be relatively low. Thus, for example, in a commercially available graphitizable isotropic carbonaceous pitch such as Ashland 240, no more than about 10% of the pitch constitutes a separable fraction capable of being thermally converted to neomesophase.

In U.S. Pat. No. 4,184,942, it has been disclosed that the heat soaking of isotropic carbonaceous petroleum pitches at temperatures in the range of about 350° C. to 450° C. results in an increase in that fraction of the pitch which is capable of being converted to neomesophase. Heat treatment normally is conducted to the point at which spherules can be observed visually under polarized light at a magnification factor of from 10× to 1,000×. Heating of such pitches tends to result in the generation of additional solvent insoluble solids, both isotropic and anisotropic, having significantly higher softening points and viscosities which are generally not suitable for spinning and which are not readily separable from the neomesophase former fraction of the pitch. Substantially all of the quinoline insoluble substances in the pitch can be removed by fluxing the pitch with an appropriate fluxing agent and thereafter separating the fluxed pitch from the solids suspended therein as disclosed in copending Application Ser. No. 29,760, filed Apr. 13, 1979, which application is incorporated herein by reference.

Returning to the process of the present invention, it is optional, although particularly desirable, to heat soak an isotropic carbonaceous petroleum pitch at temperatures in the range of about 350° C. to 450° C. at least until spherules visible under polarized light at a magnification factor of from 10× to 1,000× begin to appear in the pitch. Indeed, for the purpose of evaluating the period of time in which heat soaking should continue, the optical anisotropy of the pitch need not be performed by the conventional technique of observing polished samples of appropriately heated pitch fractions by polar light microscopy, but rather a simplified technique of observing the optical activity of crushed samples of the pitch can be employed. Basically, this simplified technique requires placing a small sample of the heat soaked pitch on a slide with a histiological mounting medium such as the histiological mounting medium sold under the trade name Permount by Fisher Scientific Company, Fairlawn, N.J. A slip cover is then placed on top of the mounted sample which is thereafter crushed between the slide and cover to provide an even dispersion of material for viewing under polarized light. The appearance of spherules in the crushed sample which are visible under polarized light is a sufficient indication that heat soaking is adequate. Optionally, heat soaking of the pitch can continue for longer periods of time; however, prolonged heating does result occasionally in formation of additional insoluble fractions which, although separable by the process of the present invention, do not enhance the overall yield of the desired carbon fiber feedstock.

Optionally, an inert stripping gas such as nitrogen, natural gas and the like can be used during heat soaking to assist in the removal of lower molecular weight and volatile substances from the pitch if the pitch employed contains considerable quantities of materials volatile at temperatures up to 340° C. For pitches that do not contain significant amounts of volatile materials such as residual oils, purging the pitch with a stripping gas generally is not desirable.

After heat soaking for the requisite time period, the heat soaked product is mixed with an organic fluxing liquid. As used herein, the term "organic fluxing liquid" refers to an organic solvent or mixtures thereof which is nonreactive toward the carbonaceous graphitizable pitch and which, when mixed with the pitch in sufficient amounts, will render the pitch sufficiently fluid so that it can be easily handled and which causes substantially all of the quinoline insoluble fraction of the pitch to be suspended in the fluid pitch. Typical organic fluxing liquids suitable in the practice of the present invention include tetrahydrofuran, light aromatic gas oils, heavy aromatic gas oils, toluene, tetralin and mixtures thereof. As should be readily appreciated, the amount of organic fluxing liquid employed will vary depending upon the temperature at which the mixing is conducted and, indeed, depending upon the composition of the pitch itself. As a general guide, however, the amount of organic fluxing liquid employed will be in the range of about 0.5 parts by weight of organic liquid per part by weight of pitch to 3 parts by weight of organic liquid per part by weight of pitch. Preferably the weight ratio of flux to pitch will be in the range of from 1:1 to 2:1. The desirable ratio of fluxing liquid to pitch can be determined very quickly on a sample of the pitch by measuring the amount of fluxing liquid required to lower the viscosity of the pitch sufficiently at the desired temperature and pressure conditions that the pitch will be able to flow through a half micron filter generally with suction filtration; however, filtration under pressure can be used to advantage if the fluxing liquid is very volatile. As a further example, it has been found that one part by weight of tetrahydrofuran per part by weight of heat soaked Ashland 240 is sufficient to render the pitch sufficiently fluid at ambient temperatures and to result in the suspension of all of the quinoline insoluble materials in the pitch. On the other hand, in the case of toluene, the ratio of toluene on a weight basis to pitch will be about 0.5 or 1 to 1 when the pitch and toluene are heated at refluxing toluene temperature (B.P. 110° C.).

After fluxing the pitch in such a manner as to provide that substantially all the quinoline insoluble fraction of the pitch is suspended in the fluid pitch, the insoluble solids can then be separated, for example, by the usual techniques of either sedimentation, centrifugation or filtration.

As will be readily appreciated, if filtration is the selected separation technique employed, a filter aid can be used if so desired to facilitate the separation of the fluid pitch from the soluble material suspended in the pitch.

The solid materials which are removed from the fluid pitch consist substantially of all of the quinoline insoluble materials such as coke and catalyst fines which were present in the pitch prior to heat soaking as well as those quinoline insolubles generated during heat soaking. The solid material removed during the separation step also contains small amounts of high softening quinoline soluble materials. Nonetheless, because of their significantly high softening points, these materials are undesirable in any feed to be used for carbon fiber production. Consequently, their removal at this stage is also particularly advantageous.

After separation of the solid material suspended in the fluid pitch, the fluid pitch is then treated in a plurality of stages with increasing amounts from first stage to last with an antisolvent and preferably at ambient temperature. The total amount of antisolvent employed should be sufficient to precipitate at least a substantial portion of the pitch. Typically from about 5 ml to about 150 ml of antisolvent per gram of pitch is sufficient to precipitate the requisite amount of the pitch. The amount of antisolvent used in each stage is largely a matter of choice and depends, in part, on the desired softening point of the solid pitch product, the number of stages used, the antisolvent employed and the like. The precise amount can be determined empirically. As a general guide, however, in a two-stage process from about 5% to about 15% of the antisolvent will be employed in the first stage and from about 85% to about 95% of the antisolvent will be employed in the second stage.

As will be appreciated, any solvent system, i.e., a solvent or mixture of solvents, which will result in the precipitation and flocculation of the fluid pitch can be employed in the practice of the present invention. However, since it is particularly desirable in the practice of the present invention to use that fraction of the pitch which is convertible into neomesophase, a solvent system particularly suitable in separating the neomesophase former fraction of the pitch from the remainder of the isotropic pitch is particularly preferred for precipitating the pitch.

Typically such solvent systems include aromatic hydrocarbons such as benzene, toluene, xylene and the like, and mixtures of such aromatic hydrocarbons with aliphatic hydrocarbons such as toluene-heptane mixtures. The solvents or mixtures of solvents typically will have a solubility parameter of between about 8.0 and 9.5 and preferably between about 8.7 and 9.2 at 25° C. The solubility parameter, $\gamma$, of a solvent or a mixture of solvents is given by the expression $$\gamma = \left(\frac{H_v - RT}{V}\right)^{\frac{1}{2}}$$

where $H_v$ is the heat of vaporization of the material, R is the molar gas constant, T is the temperature in degrees K., and V is the molar volume. In this regard, see, for example, J. Hildebrand and R. Scott, "Solubility of Non-Electrolytes," 3rd edition, Reinhold Publishing Company, New York (1949) and "Regular Solutions," Prentice Hall, New Jersey (1962). The solubility parameters at 25° for some typical hydrocarbons in commercial $C_6$ to $C_8$ solvents are as follows: benzene, 9.2; toluene, 8.9; xylene, 8.8; n-hexane, 7.3; n-heptane, 7.4; methyl cyclohexane, 7.8; and cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred, having greater than about 60 volume % toluene, such as 60% toluene/40% heptane, and 85% toluene/15% heptane.

After precipitation of the pitch in each stage, and particularly in the instances where the proper solvent system was used, separation of the neomesophase former fractions of the pitch can be readily effected by normal solid separation techniques such as sedimentation, centrifugation and filtration. If an antisolvent is used which does not have the requisite solubility parameter to effect separation of the neomesophase former fraction of the pitch, it will, of course, be necessary to separate the precipitated pitch and extract the precipitate with an appropriate solvent as described above to provide the neomesophase former fraction.

In any event, the neomesophase former fraction of the pitch prepared in accordance with the process of the present invention and particularly a two-stage process of the present invention is eminently suitable for carbon fiber production. Indeed, the present invention provides an isotropic carbonaceous pitch which is substantially free of quinoline insoluble materials as well as substantially free from other pitch components which detrimentally affect the spinnability of the pitch because of their relatively high softening points. Importantly, the process of this invention provides a simple method of separating from a carbonaceous pitch a fraction of that pitch having a preselected softening range and viscosity suitable for spinning, notwithstanding, for example, different thermal histories for each pitch employed.

A more complete understanding of the process of this invention can be obtained by reference to the following examples which are illustrative only and are not meant to limit the scope thereof which is fully disclosed in the hereinafter appended claims.

EXAMPLES 1 to 5

In each of these examples, a pitch was subjected to a heat soaking treatment at atmospheric pressure and in an inert nitrogen atmosphere. First, the pitch was charged into a kettle, the air removed by applying a vacuum, and the pressure brought to atmospheric by introducing nitrogen gas. This procedure was repeated several times to insure complete removal of gaseous oxygen. After so flushing the vessel with nitrogen, the charge was heated. The heating times and temperature after so charging are shown in Table I.

TABLE I

| | | | Insolubles, Wt. % (Softening Point, °C.) | | |
|---|---|---|---|---|---|
| Example | Pitch Parts by Weight | Heat Treatment (temp °C./time) | From Flux-Filter 2:1/THF:Pitch | In Stage 1 0.8 Toluene | In Stage 2 7.2 Toluene |
| 1 | Ashland 240 | 400° C./1 hour | 0.64 | 0.72 (402–450°) | 16.3 (356–390°) |
| 2 | Ashland 240 | 400° C./1 hour | 1.48 | 3.14 (402–450°) | 18.9 (360–377°) |
| 3 | Ashland 212 | None | 1.20 | 9.4 (400–425°) | 28.1 (353–384°) |
| 4 | Ashland 240 | 400° C./1 hour | 2.70 | 13.4 (400–450°) | 20.5 (350–375°) |
| 5 | Ashland 240 | 429° C./50 min. | 4.89 | 14.0 (402–436°) | 15.3 (350–385°) |

After heating, the charge was recovered and pulverized, also in an inert atmosphere. Thereafter a sample of each heat treated pitch was fluxed in accordance with the following procedure:

A 125 ml Erlenmeyer flask was charged with 5 grams of the pulverized heat soaked pitch and 10 grams of tetrahydrofuran. This mixture was agitated, with ultrasonic assist, over an hour at ambient temperature and the resultant fluid pitch was filtered through a half micron Millipore filter under a nitrogen atmosphere. The fluid pitch insoluble solid fraction was weighed.

The fluid pitch filtrate obtained from filtering the fluxed pitch was added to 4 grams of toluene and mixed therewith for 60 minutes. The precipitate formed and the resultant mixture were filtered to separate the precipitate which, after drying in a vacuum oven at 100° C., was weighed.

The filtrate obtained after treatment with the first fraction of antisolvent material was then added to 36 grams of toluene and mixed therein for 60 minutes. The precipitate obtained in this second stage was again separated by filtration and dried in a vacuum oven at 100° C. Thereafter the material was weighed and the softening point of each of the solvent insoluble fractions of the pitch was determined in a nitrogen blanketed capped NMR tube.

The conditions and results of the foregoing experiments are set forth in further detail in Table I.

As can be seen from the foregoing, the staged treatment of the fluid pitch with an increasing amount of a suitable antisolvent compound effectively fractionates the pitch into a plurality of separable fractions, each succeeding fraction having a lower softening point of the preceding fraction, thereby mixing it possible to select a fraction with a predetermined softening point suitable for carbon artifact manufacture.

What is claimed is:

1. A process for preparing a pitch suitable for carbon artifact manufacture comprising:

mixing an isotropic carbonaceous graphitizable pitch with an organic fluxing liquid to provide a fluid pitch;

separating solids suspended in said fluid pitch;

treating said fluid pitch in a plurality of stages with increasing amounts from the first stage to the last stage with an organic solvent system, the sum total of said organic solvent of all the stages being sufficient to precipitate at least a substantial portion of the pitch; and recovering the solvent insoluble fraction of each stage.

2. The process of claim 1 wherein said organic solvent system is selected from organic solvents and mixtures thereof having a solubility parameter at 25° of between about 8.0 and about 9.5.

3. The process of claim 2 wherein the fluid pitch is treated in two stages in an amount of organic solvent sufficient to provide a solvent insoluble fraction in said second stage which is thermally convertible into a deformable pitch containing greater than 75% of an optically anisotropic phase.

4. The process of claim 2 wherein said fluid pitch is treated in said first stage with from about 5% to 15% of the organic solvent system and from 85% to 95% of the organic solvent system being used in said second stage.

5. The process of claim 2 wherein the pitch is fluxed by adding a fluxing liquid selected from the group consisting of light aromatic gas oils, heavy aromatic gas gas oils, tetrahydrofuran, toluene, xylene, tertralin and mixtures thereof.

6. In the process of preparing a pitch suitable for carbon artifact manufacture wherein a carbonaceous isotropic graphitizable pitch is fluxed with an organic fluxing liquid to provide a fluid pitch having insoluble solids suspended therein and wherein said solvent insolubles are separated from said fluid pitch and said fluid pitch is thereafter treated with an organic solvent system having a solubility parameter at 25° of between about 8.0 and 9.5 in an amount sufficient to provide a solvent insoluble fraction thermally convertible into a deformable pitch containing greater than 75% of an optically anisotropic phase, the improvement comprising treating said fluid pitch with from 5% to 15% of said solvent system in a first stage, separating the solid formed in said first stage, and thereafter treating the remainder of the fluid pitch in a second stage with from about 85% to 95% of the organic solvent system to provide a solvent insoluble fraction, and thereafter separating said solvent insoluble fraction.

7. A process of treating isotropic carbonaceous graphitizable pitch to provide a feedstock suitable for carbon fiber manufacture comprising:

providing an isotropic graphitizable carbonaceous pitch;

treating said pitch with an organic fluxing liquid selected from the group consisting of light aromatic gas oils, heavy aromatic gas oils, tetrahydrofuran, toluene, xylene, tetralin, and mixtures thereof to provide a fluid pitch having solids suspended therein;

separating said solids suspended in said fluid pitch;

treating said fluid pitch with an organic solvent system having a solubility parameter at 25° of between about 8.0 and about 9.5, said treating being conducted in two stages, said treating being at a temperature and with an amount of organic solvent sufficient to provide a solvent insoluble fraction thermally convertible into a deformable pitch containing greater than 75% of an optically anisotropic phase, said treating being conducted in two stages using from about 5 to 15% of said organic solvent system in said first stage and from 85 to about 95% of said solvent system in said second stage, the solvent insoluble fraction precipitated during treating in said first stage being separated prior to treatment of the fluid pitch in said second stage; and recovering said solid from the insoluble fraction obtained from said second stage, whereby a carbonaceous pitch having suitable softening point and viscosity for spinning is obtained.

* * * * *